US008978637B2

(12) United States Patent
Ryu et al.

(10) Patent No.: US 8,978,637 B2
(45) Date of Patent: Mar. 17, 2015

(54) TOP BURNER AND COOKER COMPRISING THE SAME

(75) Inventors: Jung Wan Ryu, Changwon (KR); Dae Bong Yang, Changwon (KR); Jea Hyuk Wie, Changwon (KR); Yong Ki Jeong, Changwon (KR); Jae Bum Lim, Changwon (KR); Young Soo Kim, Changwon (KR); Yang Ho Kim, Changwon (KR); Dae Rae Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 851 days.

(21) Appl. No.: 12/809,029

(22) PCT Filed: Dec. 17, 2008

(86) PCT No.: PCT/KR2008/007500
§ 371 (c)(1),
(2), (4) Date: Sep. 13, 2010

(87) PCT Pub. No.: WO2009/078674
PCT Pub. Date: Jun. 25, 2009

(65) Prior Publication Data

US 2011/0186037 A1 Aug. 4, 2011

(30) Foreign Application Priority Data

Dec. 17, 2007 (KR) ..... 10-2007-0132489

(51) Int. Cl.

| | |
|---|---|
| ***F24C 3/08*** | (2006.01) |
| ***F24C 3/00*** | (2006.01) |
| ***F24C 15/10*** | (2006.01) |
| ***F23D 14/08*** | (2006.01) |
| ***F24C 3/12*** | (2006.01) |
| ***F23D 14/06*** | (2006.01) |

(52) U.S. Cl.
CPC ..... *F24C 3/085* (2013.01); *F23D 14/06* (2013.01)
USPC ..... 126/39 K; 126/39 R

(58) Field of Classification Search
CPC ..... F23D 14/58; F23D 2900/14061; F23D 2900/14062; F23D 2900/14063; F23D 2900/14064; F23C 3/106
USPC ..... 126/39 K, 39 R, 39 H, 39 E, 214 A; 431/278, 191, 266, 284, 354, 283, 268, 431/198; 239/558, 561
See application file for complete search history.

(56) References Cited

U.S. PATENT DOCUMENTS

| | | | | |
|---|---|---|---|---|
| 6,325,619 | B2 * | 12/2001 | Dane | 431/284 |
| 2005/0142511 | A1 * | 6/2005 | Yam et al. | 431/285 |
| 2006/0121402 | A1 * | 6/2006 | Bettinzoli | 431/354 |
| 2007/0151556 | A1 * | 7/2007 | Cadima | 126/39 E |

FOREIGN PATENT DOCUMENTS

| | | | |
|---|---|---|---|
| JP | 52-53885 | U | 4/1977 |
| JP | 52-154732 | U | 11/1977 |
| JP | 1-118024 | A | 5/1989 |
| KR | 10-2004-0097794 | A | 11/2004 |

* cited by examiner

*Primary Examiner* — Avinash Savani
*Assistant Examiner* — Vivek Shirsat
(74) *Attorney, Agent, or Firm* — Birch, Stewart, Kolasch & Birch, LLP

(57) ABSTRACT

A top burner and a cooker having the top burner are provided. The top burner includes a first burner provided with a plurality of flame holes that form flame by combusting mixed gas and a second burner provided with a plurality of flame holes that form flame separated from the flame formed by the flame holes of the first burner by combusting the mixed gas. An arrangement of the flame holes of the first burner is realized in a different shape from an arrangement of the flame holes of the second burner.

17 Claims, 4 Drawing Sheets

TOP BURNER AND COOKER COMPRISING THE SAME

TECHNICAL FIELD

The present disclosure relates to a cooker, and more particularly, to a top burner for cooking food by combusting gas and a cooker having the top burner.

BACKGROUND ART

A cooker is a home appliance that cooks food using gas or electric power. For the cooker using the gas, the cooker has a burner that cooks the food by heating a container containing the food by combusting the gas. The burner typically includes a top burner main body supplying gas, a top burner head coupled to an upper end of the top burner main body, and a top burner cap, flame holes through which the gas jets out being formed between the top burner cap and the burner head.

DISCLOSURE OF INVENTION

Technical Problem

Embodiments provide a top burner that is designed to effectively heat a variety of containers having different shapes and a cooker having the top burner.

Embodiments also provide a top burner that can be manufactured with a simple structure and less expenses and a cooker having the top burner.

Technical Solution

In an embodiment, a top burner includes: a first burner provided with a plurality of flame holes that form flame by combusting mixed gas; and a second burner provided with a plurality of flame holes that form flame separated from the flame formed by the flame holes of the first burner by combusting the mixed gas, wherein an arrangement of the flame holes of the first burner is realized in a different shape from an arrangement of the flame holes of the second burner.

In another embodiment, a top burner includes: an outer burner installed on a top surface of a top plate and provided at an edge thereof with a plurality of flame holes that form flame by combusting mixed gas; and an inner burner installed on a top surface of the outer burner and provided at an edge located at an inside of the edge of the outer burner with a plurality of flame holes that form flame by combusting the mixed gas, wherein a distance between one of the flame holes of the inner burner and one of the flame holes of the outer burner, which is closest to the one of the flame holes of the inner burner is different from a distance between another one of the flame holes of the inner burner and another one of the flame holes of the outer burner, which is closest to the another one of the flame holes of the inner burner.

In still another embodiment, a cooker includes: a top plate defining an exterior of a top thereof; a top grid that is provided on the top plate and on which an object to be heated is disposed; the top burner according to any one of claims 8 to 14, for heating the object disposed on the top grid; a valve supplying mixed gas to the top burner; and a manipulation knob controlling operation of a valve.

Advantageous Effects

According to the embodiments, the top burner can effectively heat a variety of containers having different shapes and be manufactured with a simple structure and less expenses.

BEST MODE FOR CARRYING OUT THE INVENTION

Reference will now be made in detail to the embodiments of the present disclosure, examples of which are illustrated in the accompanying drawings.

Figure 1:
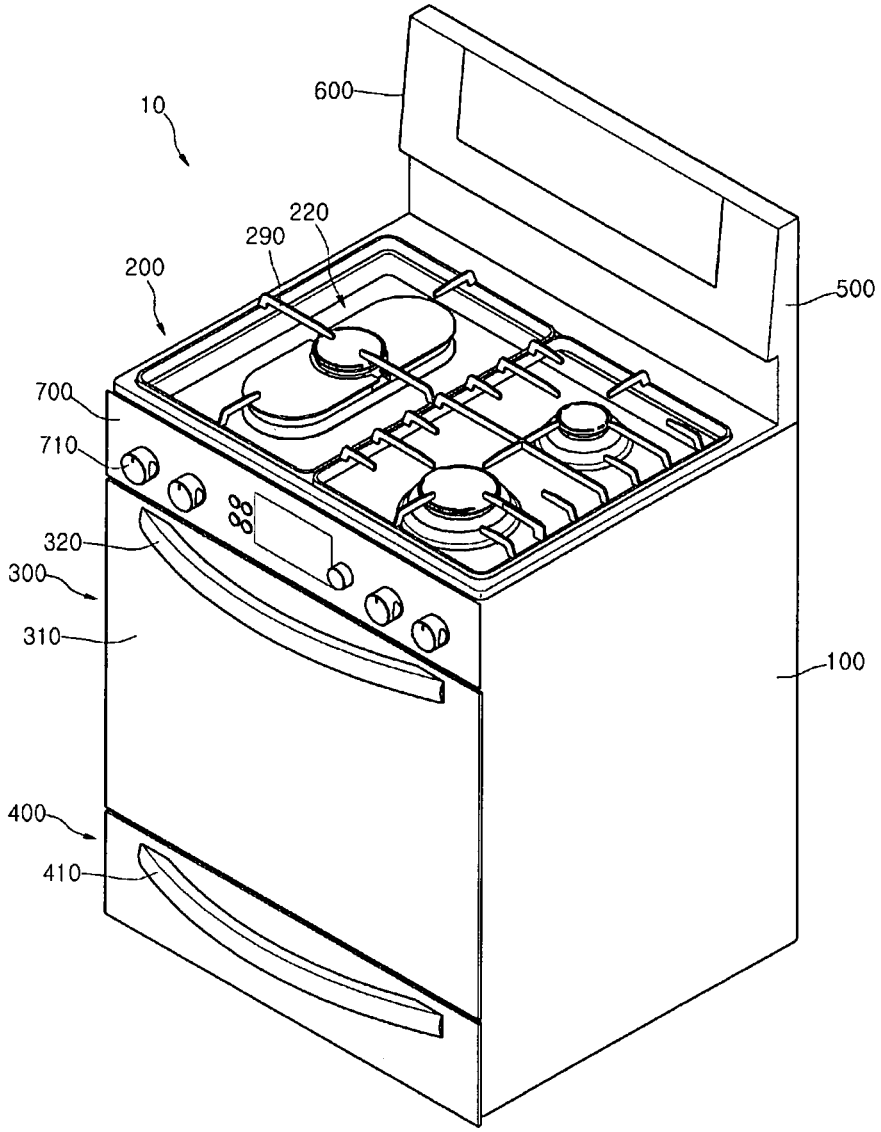
FIG. 1 is a perspective view of a cooker according to an embodiment.
Figure 2:
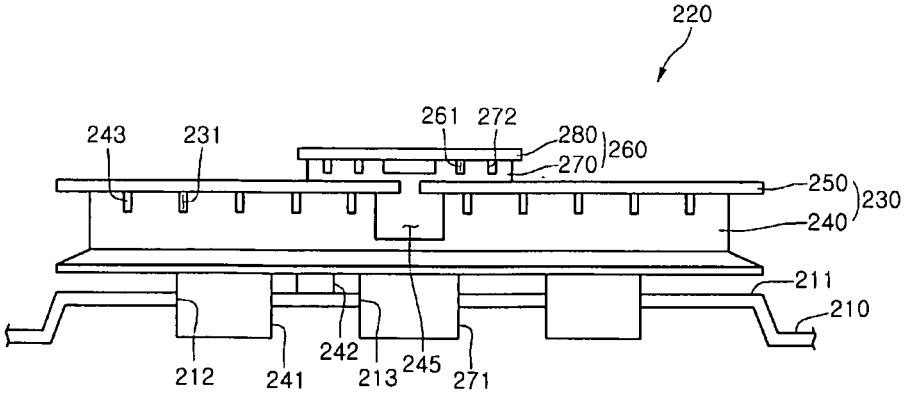
FIG. 2 is a side view of a top burner according to an embodiment.
Figure 3:
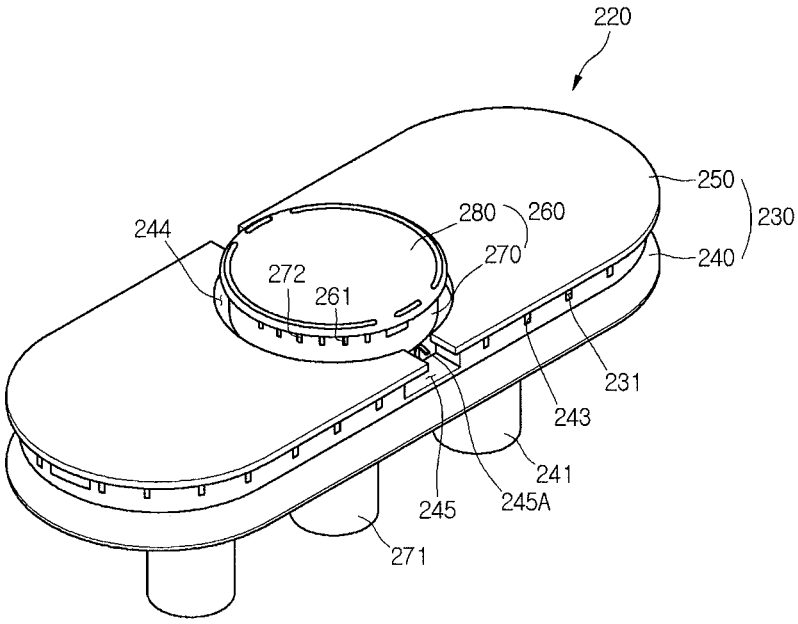
FIG. 3 is a perspective view of the top burner according to the embodiment of FIG. 2.

FIG. 1 is a perspective view of a cooker according to an embodiment, FIG. 2 is a side view of a top burner according to an embodiment, and FIG. 3 is a perspective view of the top burner according to the embodiment of FIG. 2.

Referring to FIG. 1, an exterior of a cooker 10 according to an embodiment is defined by a main body 100. The main body 100 includes a top burner unit 200, an oven unit 300, a warming drawer 400, a back guard 500, a control panel 600, and a top burner control unit 700.

Food is cooked at the top burner unit 200 and the oven unit 300. The warming drawer 400 is for warming a container containing the food. The control panel 600 is for receiving manipulation signals for the operation of the cooker 10 and displaying a variety of information related to the operation of the cooker 10. The top burner control unit 700 is for controlling the top burner unit 200 and the back guard 500 is for guiding the combustion gas generated during the cooking of the food in the oven unit 300.

In more detail, the top burner unit 200 is provided on a top of the main body 100. The top burner unit 200 has a plurality of top burners 220. The top burners 220 functions to heat the container containing the food by combusting the gas. The top burners 220 will be described in more detail later.

In addition, the top burner unit 200 includes a plurality of top grids 290. The container that will be heated by the top burner 220 is disposed on the top grids 290.

Meanwhile, the oven unit 300 is provided at a central portion of the main body 100 under the top burner unit 200. An oven chamber (not shown) in which the food is cooked is defined in the oven unit 300. The oven is selectively opened and closed by a door 310. The door 310 selectively opens and closes the oven chamber as an upper end of the door 310 pivots about a lower end of the door 310. A door handle 320 is provided on a front-upper end of the door 310. A user grasps the door handle 320 and opens and closes the door 310.

Further, the warming drawer 400 is provided on a lower end of the main body 100 under the oven unit 300. The warming drawer 400 is installed to be drawn in and out of the main body. The container containing the food is disposed on the warming drawer 400 and the container disposed on the warming drawer 400 is heated by a heater for cooking the food or a separate heater for warming. A drawer handle 410 is provided on a front surface of the warming drawer 400. The user grasps the drawer handle 410 and draws in and out the warming drawer 400.

The back guard 500 is provided on a top-rear end of the main body 100 behind the top burner unit 200. The back guard 500 extends upward from the top of the main body 100. A fluid passage communicating with the oven chamber is provided in the back guard 500. Therefore, the combustion gas that is generated during the cooking of the food in the oven unit 300 (i.e., the oven chamber) is discharged out of the oven unit 300 through the fluid passage.

The control panel 600 is provided on the front surface of the back guard 500. The control panel 600 includes an input unit receiving a variety of manipulation signals for operating the oven unit 300 or the warming drawer 400 and a display unit for displaying a variety of information related to the operation of the oven unit 300 and the warming drawer 400.

Further, the top burner control unit 700 includes a plurality of manipulation knobs 710, the number of which corresponds to the number of the top burners 220. The manipulation knobs 710 selectively open and close valves (not, shown) for supplying gas to the respective top burners 220 or control openings of the respective valves. The control of the valves by the manipulation knobs 710 will be described later.

Referring to FIGS. 2 and 3, an exterior of the top of the top burner unit 200 is defined by a top plate 210. The top plate 210 is provided with a top burner installing portion 211 on which the top burners 220 are installed. The top burner installing portion 211 protrudes upward such that a portion of the top plate 210 has a circular cross-section. Therefore, a top of the top burner installing portion 211 is substantially located to be relatively higher than a top of the top plate 210.

The top plate 210 is provided with first and second insertion holes 212 and 213. First and second mixing tubes 241 and 271 to be described later are respectively inserted into the first and second insertion holes 212 and 213 of the top plate 210. The first and second insertion holes 212 and 213 of the top plate 210 are formed by partly cutting the top burner installing portion 211.

The top burner 220 includes an outer burner 230 and an inner burner 260. The outer burner 230 is for heating a container having an oval or rectangular bottom, i.e., a bottom having long and short sides. The inner burner 260 is for heating a top having a roughly circular bottom. In this embodiment, in a simmer mode for heating the food at a relatively low temperature, only the inner burner 260 is used. In a cooking mode, both the outer burner 230 and the inner burner 260 or only the inner burner 260 are used in accordance with the shape of the bottom of the container. Further, the outer burner 230 includes an outer burner head 240 and an outer burner cap 250. The inner burner 260 includes an inner burner head 270 and an inner burner cap 280.

The outer burner head 240 is formed to have a track-shaped cross-section that is formed by rounding opposite ends of the rectangular shape. Alternatively, the outer burner head 240 may be formed to have a rectangular cross-section. The outer burner head 240 is disposed on the top of the top burner installing portion 211.

The outer burner head 240 is provided with two first gas mixing tubes 241. The first gas mixing tubes 241 are for supplying gas mixed with air (hereinafter, referred to as mixed gas) that is injected through nozzles (not shown) provided in the top burner unit 200 under the top plate 210. Upper ends of the first gas mixing tubes 241 extend upward from the top of the outer burner head 240. Further, lower ends of the first gas mixing tubes 241 extend downward from an undersurface of the outer burner head 240 and inserted into the first insertion holes 212 of the top plate 210.

Three supporting protrusions 242 are provided on the undersurface of the outer burner head 240. The supporting protrusions 242 function to support the outer burner head 240 on the top of the to burner installing portion 211. Accordingly, the undersurface of the outer burner head 240 is spaced apart from the top surface of the top burner installing portion 211 by a height of the supporting protrusions 242.

A plurality of flame hole forming teeth 243 are provided on an edge of the top of the outer burner head 240. The flame hole forming teeth 243 of the outer burner head 240 are for forming flame holes 231 of the outer burner 230. The mixed gas is discharged and combusted through the flame holes 231. Therefore, in this embodiment, the flame holes 231 of the outer burner 230 are arranged in a track shape.

Further, an inner burner seating portion 244 is provided on a central portion of the outer burner head 240. The inner burner seating portion 244 is for supporting the inner burner 260. The inner burner seating portion 244 is formed in a corresponding cylindrical shape to the inner burner 260. The flat hole forming teeth 243 of the outer burner head 240. The flame hole forming teeth 243 of the outer burner head 240 is formed on an edge surface of the outer burner head 240 except for an edge surface of the outer burner head 240 that forms the inner burner seating portion 244. Therefore, it can be referred that the flame holes 231 of the outer burner 230 are formed on the edge of the outer burner 230 except for the inner burner seating portion 244.

Further, an ignition portion 245 is formed on a side of the outer burner head 240. The ignition portion 245 is a portion where an end portion of an ignition plug 245A is disposed. In this embodiment, the mixed gases of the outer and inner burners 230 and 260 are simultaneously ignited by a spark generated by the ignition plug.

The outer burner cap 250 is disposed on a top surface of the outer burner head 240 except for the inner burner seating portion 244. In this embodiment, two outer burner caps 250 are disposed on the top surface of the outer burner head 240 except for the central portion (i.e., the inner burner seating portion 244) of the outer burner head 240. Alternatively, it may be also possible that one outer burner cap 250 is disposed on the top surface of the outer burner head 240 except for the central portion (i.e., the inner burner seating portion 244) of the outer burner head 240. In addition, the flame holes 231 of the outer burner 230 are formed between an inner circumference of the undersurface of the outer burner cap 250 and the flame hole forming teeth 243 of the outer burner head 240.

The inner burner head 270 is disposed on the outer burner head 240, substantially the inner burner seating portion 244. The inner burner head 270 has an approximately cylindrical cross section corresponding to the inner burner seating portion 244.

The inner burner head 270 has a second gas mixing tube 271. The second gas mixing tube 271 is for supplying the mixed gas to the inner burner 260. The second gas mixing tube 271 extends downward from the undersurface of the inner burner head 270 and inserted into the second insertion hole 213 through the outer burner cap 250 and the outer burner head 240.

The inner burner head 270 is provided at an edge of the top thereof with a plurality of flame hole forming teeth 272. The flame hole teeth 272 of the inner burner head 270 are form forming flame holes 261 of the inner burner 260. The mixed gas is discharged and combusted through the flame holes 261.

The inner burner cap 280 is supported on the top surface of the inner burner head 270. The flame holes 261 of the inner burner 260 are formed between an inner circumference of an undersurface of the inner burner cap 280 and the flame hole forming teeth 272 of the inner burner head 270.

Meanwhile, as described above, the valve for supplying the gas to the top burner 220 is controlled by the manipulation knob 710. In more detail, the manipulation knob 710 controls whether to supply the gas to the inner burner 250 or the outer burner 230 and inner burner 250 and adjusts an amount of the gas supplied to the inner burner 250. The control of the valve for controlling whether to supply the gas to the inner burner 250 or the outer burner 230 and inner burner 250 and adjusting an amount of the gas supplied to the inner burner 250 is performed by one corresponding manipulation knob 710.

For example, when the manipulation knob 710 rotates in a predetermined direction (hereinafter, referred to as forward direction), the amount of the gas supplied to the inner burner 250 increases in proportion to a rotational angle of the manipulation knob 710. Next, when the manipulation knob 710 further rotates in the forward direction by a predetermined rotational angle in a state where the amount of the gas supplied to the inner burner 250 is maximum, the gas is supplied to the outer burner 230.

The operation of the cooker having the top burner of the embodiment will now be described in more detail with reference to the accompanying drawings.

Figure 4:
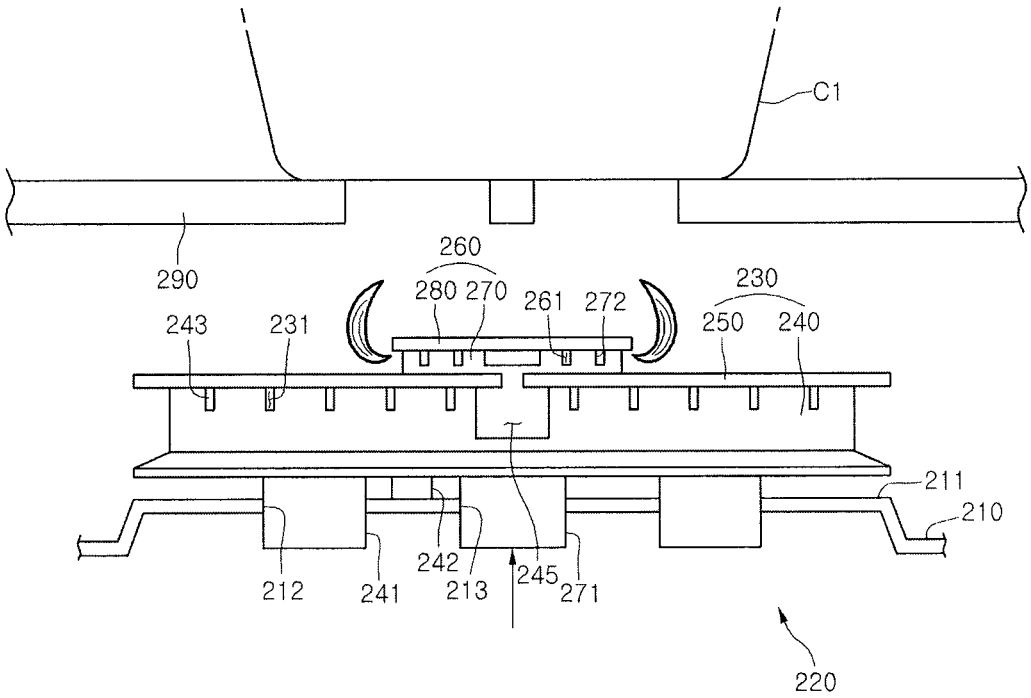
FIGS. 4 to 6 are side views illustrating a cooking state of the cooker of the embodiment of FIG. 1.
Figure 5:
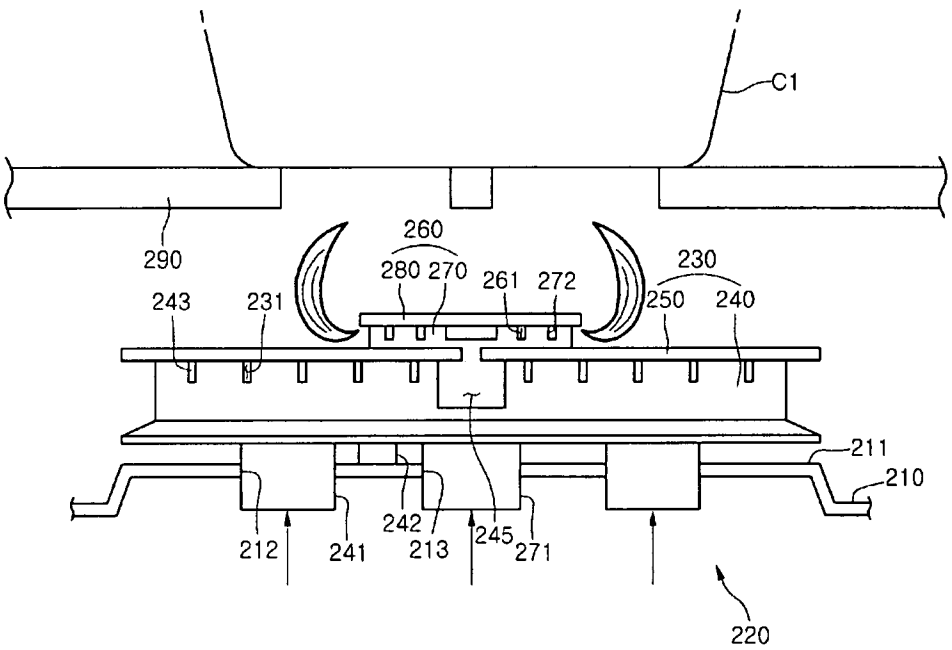
Figure 6:
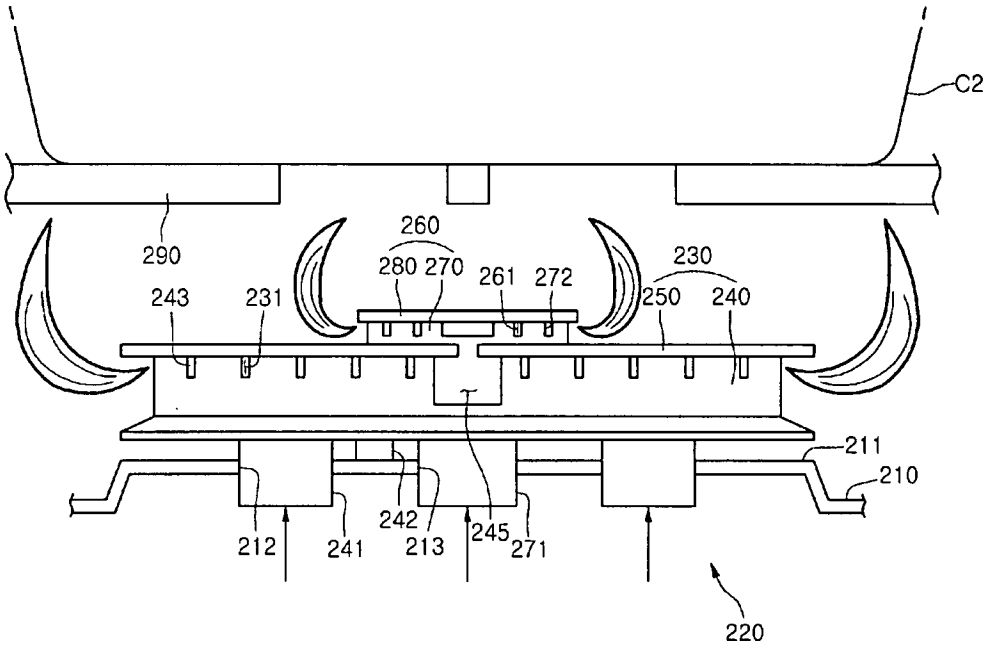

FIGS. 4 to 6 are side views illustrating a cooking state of the cooker of the embodiment of FIG. 1.

Referring first to FIGS. 4 and 5, in the cooking or simmer modes for heating a container C1 having a circular bottom, only the inner burner 260 is used to cook the food. In more detail, when the user rotates the manipulation knob 710 in the forward direction, the valve is controlled such that a predetermined amount of the gas, i.e., an amount for performing the simmer mode, is supplied. Accordingly, the gas supplied to the inner burner 250, i.e., gas mixed with the air, is discharged and combusted through the flame holes 251 of the inner burner 250 and thus the simmer mode using the inner burner 250 shown in FIG. 4 is performed. In this state, when the user further rotates the manipulation knob 710 in the forward direction, the valve is controlled such that the amount of the gas supplied to the inner burner 250 increases in proportion to the rotational angle of the manipulation knob 710. Therefore, as shown in FIG. 5, the cooking mode using the inner burner 250 is performed. In the simmer and cooking modes using the inner burner 250, the container C1 having the circular bottom can be evenly heated without unnecessarily consuming the mixed gas.

Next, referring to FIG. 6, in the cooking mode for heating a container C2 having a rectangular bottom, both the outer burner 230 and inner burner 260 are used. In more detail, when the user further rotates the manipulation knob 710 in the forward direction in a state where the cooking mode using the inner burner 250 and the amount of the gas supplied to the inner burner 250 is maximum, the valve is controlled such that the gas is supplied to not only the inner burner 250 but also the outer burner 230. Therefore, as shown in FIG. 6, the cooking mode using both the outer and inner burners 230 and 250 can be performed.

Various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

According to the present invention, the following effects can be expected.

First, the outer and inner burners are respectively formed to correspond to circular and rectangular shapes. Therefore, a variety of containers having different shapes can be more effectively heated.

Further, the inner burner is provided inside the outer burner. Therefore, a variety of containers having different shapes can be heated by one top burner, the product can be more simplified and the manufacturing costs can be reduced.

The invention claimed is:

1. A top burner comprising:

a first burner comprising a first burner head provided with a plurality of flame holes that form flame by combusting mixed gas, a first outer burner cap seated on a portion of the first burner head, and a second outer burner cap seated on another portion of the first burner head;

a second burner provided with a plurality of flame holes that form a flame separated from the flame formed by the flame holes of the first burner by combusting the mixed gas; and an ignition portion formed on the first burner head where an end portion of an ignition plug is disposed, the ignition portion defining a passage communicating an inside of the first burner head with an outside of the first burner head, wherein the ignition plug can simultaneously ignite the mixed gases of the first burner and the second burner, wherein an arrangement of the flame holes of the first burner is realized in a different shape from an arrangement of the flame holes of the second burner, wherein the first burner head comprises a bottom wall, first and second walls extended from the bottom wall, the first and second wall being parallel and spaced apart from each other, the first wall facing the second wall, wherein the bottom wall, the first wall and second wall define the ignition portion, wherein at least a portion of the ignition plug is disposed between the first and second walls, wherein the first outer burner cap and the second outer burner cap are spaced apart from each other so that the first outer burner cap and the second outer burner cap define a gap therebetween, wherein the first outer burner cap and the second outer burner cap cover a first portion of the ignition portion to expose a second portion of the ignition portion to an outside via the gap, and wherein a distance between the first and second walls is greater than the gap defined by the first and second outer burner caps.

2. The top burner according to claim 1, wherein the flame holes of one of the first and second burners are arranged in a close curve shape having alternately arranged long and short sides, and wherein the flame holes of the other of the first and second burners are arranged in a circular shape having a diameter less than a length of the short side.

3. The top burner according to claim 1, wherein one of the first and second burners is located on a top surface of the other of the first and second burners.

4. The top burner according to claim 1, wherein the first burner head is formed in an oval or rectangular shape and has a second burner seating portion on which the second burner is disposed.

5. The top burner according to claim 1, wherein the second burner comprises:

a second burner head formed in a circular shape and disposed on the top surface of the first burner; and a second cap provided on a top surface of the second burner head and forming the flame holes of the second burner together with the second burner head.

6. The top burner according to claim 1, further comprising a manipulation knob for controlling the supply of the mixed gas that will be combusted in the first and second burners and adjusting an amount of the mixed gas to the first and second burners.

7. The top burner according to claim 1, wherein the mixed gas is combusted in both the first and second burners or only in the second burner.

8. A top burner comprising:

an outer burner installed on a top surface of a top plate and comprising an outer burner head provided with a plurality of flame holes that form flame by combusting mixed gas, a first outer burner cap seated on a portion of the outer burner head and a second outer burner cap seated on another portion of the outer burner head;

an inner burner installed on a top surface of the outer burner and provided at an edge located at an inside of the edge of the outer burner with a plurality of flame holes that form flame by combusting the mixed gas; and an ignition portion formed on the outer burner head where an end portion of an ignition plug is disposed, the ignition portion communicating an inside of the outer burner head with an outside of the outer burner head, wherein the ignition plug can simultaneously ignite the mixed gases of the outer burner and the inner burner, wherein the first burner head comprises a bottom wall, first and second walls extended from the bottom wall, the first and second wall being parallel and spaced apart from each other, the first wall facing the second wall, wherein the bottom wall, the first wall and second wall define the ignition portion, wherein at least a portion of the ignition plug is disposed between the first and second walls, wherein the first outer burner cap and the second outer burner cap are spaced apart from each other so that the first outer burner cap and the second outer burner cap define a gap therebetween, wherein the first outer burner cap and the second outer burner cap cover a first portion of the ignition portion to expose a second portion of the ignition portion to an outside via the gap, and wherein a distance between the first and second walls is greater than the gap defined by the first and second outer burner caps.

9. The top burner according to claim 8, wherein the outer burner is formed in a shape having an oval or rectangular cross-section, and wherein the inner burner is formed in a shape having a circular cross-section.

10. The top burner according to claim 8, wherein the outer burner is provided with an inner burner installing portion on which the inner burner is installed, and wherein the mixed gas is supplied only into the outer burner except for the inner burner installing portion.

11. The top burner according to claim 8, wherein the outer burner head is provided with an inner burner installing portion on which the inner burner is installed; and the first and second outer burner caps shield the top surface of the outer burner head except from the inner burner installing portion.

12. A cooker comprising:

a top plate defining an exterior of a top thereof;

a top grid that is provided on the top plate and on which an object to be heated is disposed;

the top burner according to claim 8, for heating the object disposed on the top grid;

a valve supplying mixed gas to the top burner; and a manipulation knob controlling operation of a valve.

13. The cooker according to claim 12, wherein the manipulation knob controls the valve such that the mixed gas is supplied to only the inner burner or both the outer and inner burners.

14. The cooker according to claim 13, wherein the manipulation knob adjusts an amount of the mixed gas when the mixed gas is supplied only to the inner burner.

15. A cooker comprising:

a top plate defining an exterior of a top thereof;

a top grid that is provided on the top plate and on which an object to be heated is disposed;

the top burner according to claim 9, for heating the object disposed on the top grid;

a valve supplying mixed gas to the top burner; and a manipulation knob controlling operation of a valve.

16. A cooker comprising:

a top plate defining an exterior of a top thereof;

a top grid that is provided on the top plate and on which an object to be heated is disposed;

the top burner according to claim 10, for heating the object disposed on the top grid;

a valve supplying mixed gas to the top burner; and a manipulation knob controlling operation of a valve.

17. A cooker comprising:

a top plate defining an exterior of a top thereof;

a top grid that is provided on the top plate and on which an object to be heated is disposed;

the top burner according to claim 11, for heating the object disposed on the top grid;

a valve supplying mixed gas to the top burner; and a manipulation knob controlling operation of a valve.

* * * * *